US011304493B2

(12) United States Patent
Gilley

(10) Patent No.: US 11,304,493 B2
(45) Date of Patent: Apr. 19, 2022

(54) LOTION APPLICATOR ASSEMBLY

(71) Applicant: Joel Gilley, Little Elm, TX (US)

(72) Inventor: Joel Gilley, Little Elm, TX (US)

( * ) Notice: Subject to any disclaimer, the term of this patent is extended or adjusted under 35 U.S.C. 154(b) by 78 days.

(21) Appl. No.: 16/823,519

(22) Filed: Mar. 19, 2020

(65) Prior Publication Data

US 2021/0289917 A1 Sep. 23, 2021

(51) Int. Cl.

| | |
|---|---|
| ***A46B 5/02*** | (2006.01) |
| ***A45D 34/04*** | (2006.01) |
| ***B25G 1/04*** | (2006.01) |
| ***B25G 3/10*** | (2006.01) |

(52) U.S. Cl.

CPC ..... *A45D 34/04* (2013.01); *B25G 1/04* (2013.01); *B25G 3/10* (2013.01); *A45D 2200/1018* (2013.01); *A45D 2200/1036* (2013.01); *A45D 2200/1081* (2013.01)

(58) Field of Classification Search

CPC ..... A45D 34/04; A45D 2200/1081; A45D 2200/1009; B65D 47/42

USPC ..... 401/6

See application file for complete search history.

(56) References Cited

U.S. PATENT DOCUMENTS

| | | | | |
|---|---|---|---|---|
| 6,415,470 | B1 | 7/2002 | Ramrattan | |
| D531,357 | S | 10/2006 | McEwen | |
| 8,015,653 | B2 * | 9/2011 | Bargiel | A45D 34/04 15/144.2 |
| 8,141,565 | B2 | 3/2012 | Slavin | |
| 10,279,462 | B1 | 5/2019 | Kemp | |
| 2002/0069891 | A1 | 6/2002 | McCormick | |
| 2005/0175677 | A1 * | 8/2005 | Walters | A61Q 19/00 424/443 |
| 2007/0243005 | A1 | 10/2007 | Sviesa | |
| 2009/0003917 | A1 * | 1/2009 | Duncan | A45D 34/04 401/6 |

* cited by examiner

*Primary Examiner* — Jennifer C Chiang

(57) ABSTRACT

A lotion applicator assembly includes a plurality of applicators that is each pre-filled with a viscous skin treatment. Each of the applicators is substantially comprised of a fluid permeable material to release the viscous skin treatment onto a user's skin and each of the applicators has a coupler thereon. A wand is included that has a telescopically adjustable length and a releasing unit is movably coupled to the wand. The releasing unit engages the coupler on a respective one of the applicators for retaining the respective applicator on the wand. In this way the wand can be gripped to rub the respective applicator on the user's skin. Additionally, the releasing unit is urgeable into a releasing position for disengaging the coupler on the respective applicator.

13 Claims, 7 Drawing Sheets

LOTION APPLICATOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to applicator devices and more particularly pertains to a new applicator device for applying a viscous skin treatment to a user's back without assistance.

(2) Description of Related Art including Information Disclosed under 37 CFR 1.97 and 1.98

The prior art relates to applicator devices. The prior art discloses a handle with a head and a pad that is attachable to the head for applying lotion to a user's back. The prior art also discloses a handle that comprises a first portion hingedly coupled to a second portion and a pad being coupled to said handle for spreading lotion on a user. The prior art discloses a back tool that has a pair of elbows and a plurality of members extending between the elbows to facilitate a user to scratch the user's back. The prior art discloses a lotion handle that includes a sponge coupled to a head for applying lotion to a user's back.

BRIEF SUMMARY OF THE INVENTION

An embodiment of the disclosure meets the needs presented above by generally comprising a plurality of applicators that is each pre-filled with a viscous skin treatment. Each of the applicators is substantially comprised of a fluid permeable material to release the viscous skin treatment onto a user's skin and each of the applicators has a coupler thereon. A wand is included that has a telescopically adjustable length and a releasing unit is movably coupled to the wand. The releasing unit engages the coupler on a respective one of the applicators for retaining the respective applicator on the wand. In this way the wand can be gripped to rub the respective applicator on the user's skin. Additionally, the releasing unit is urgeable into a releasing position for disengaging the coupler on the respective applicator.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
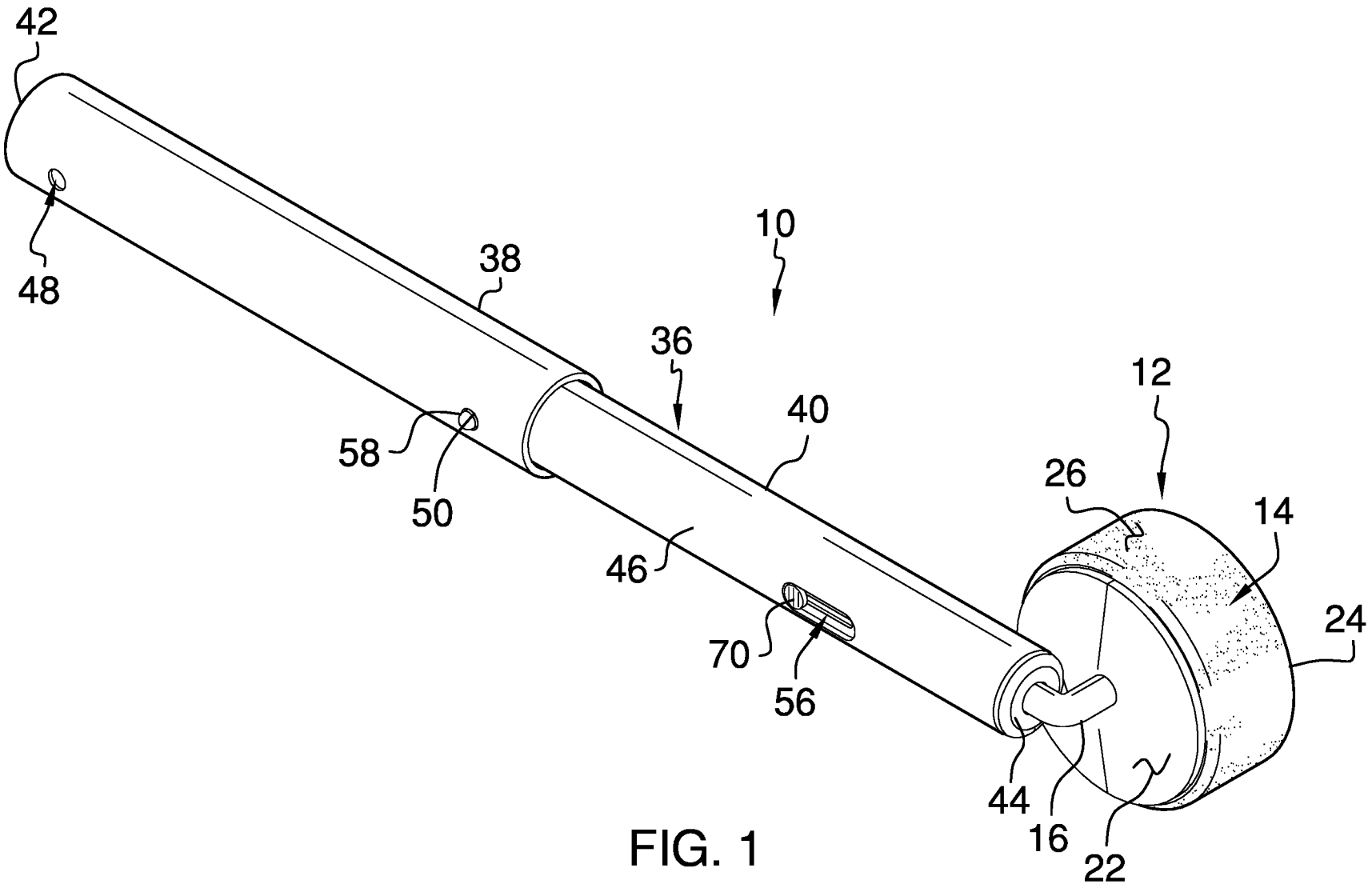
FIG. 1 is a top perspective view of a lotion applicator assembly according to an embodiment of the disclosure.
Figure 3:
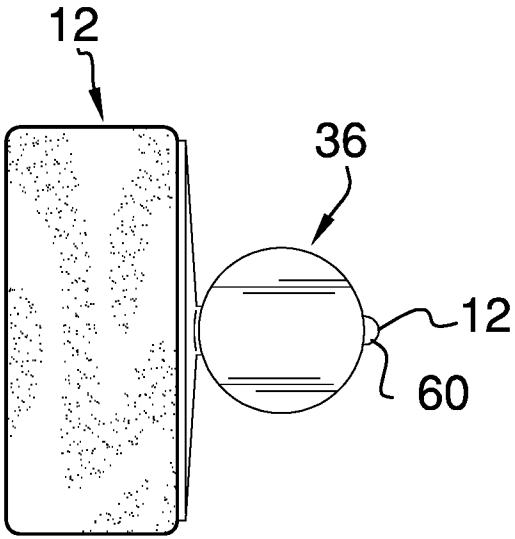
FIG. 3 is a back view of an embodiment of the disclosure.
Figure 2:
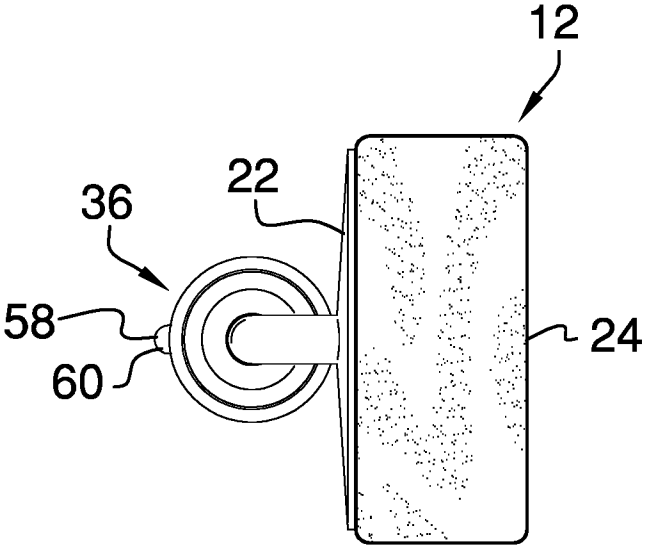
FIG. 2 is a front view of an embodiment of the disclosure.
Figure 4:
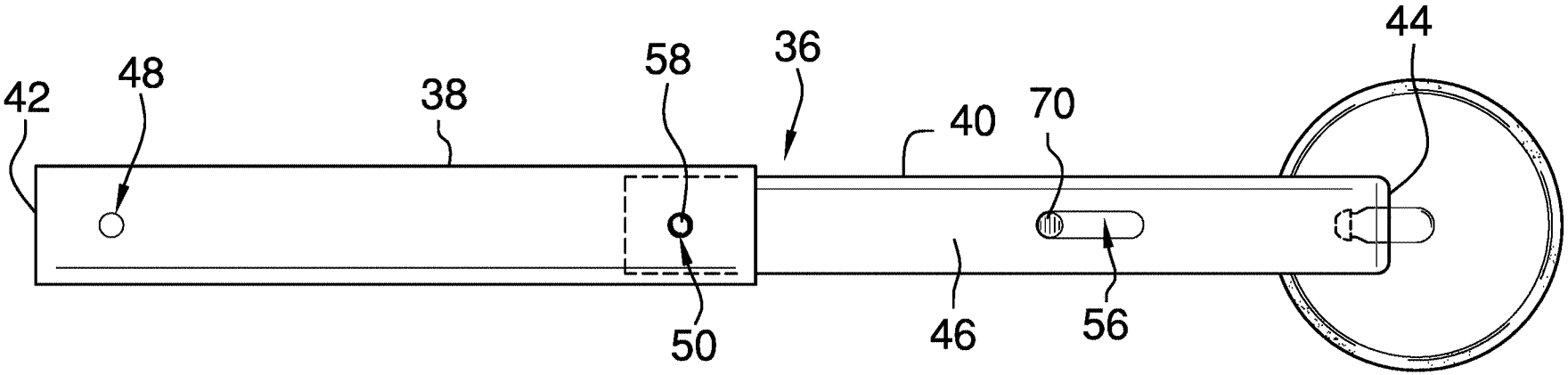
FIG. 4 is a top phantom view of an embodiment of the disclosure.
Figure 5:
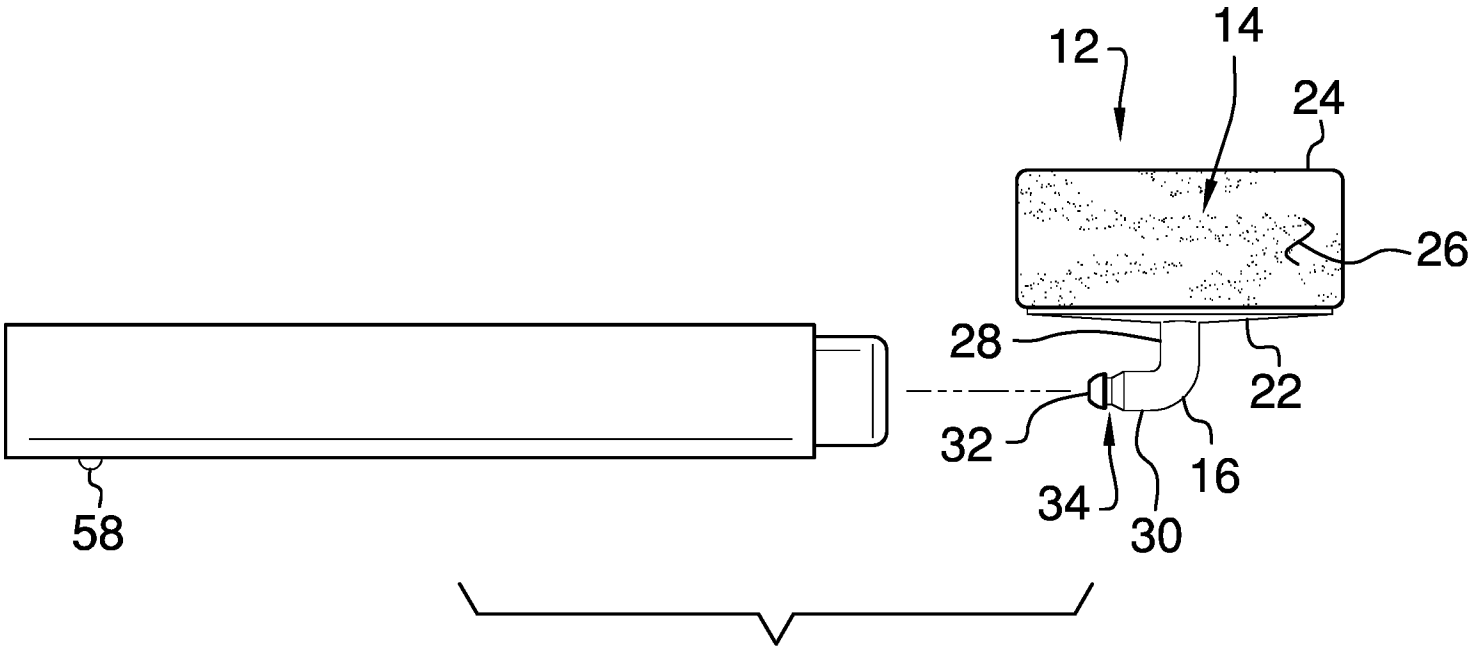
FIG. 5 is a left side exploded view of an embodiment of the disclosure.
Figure 6:
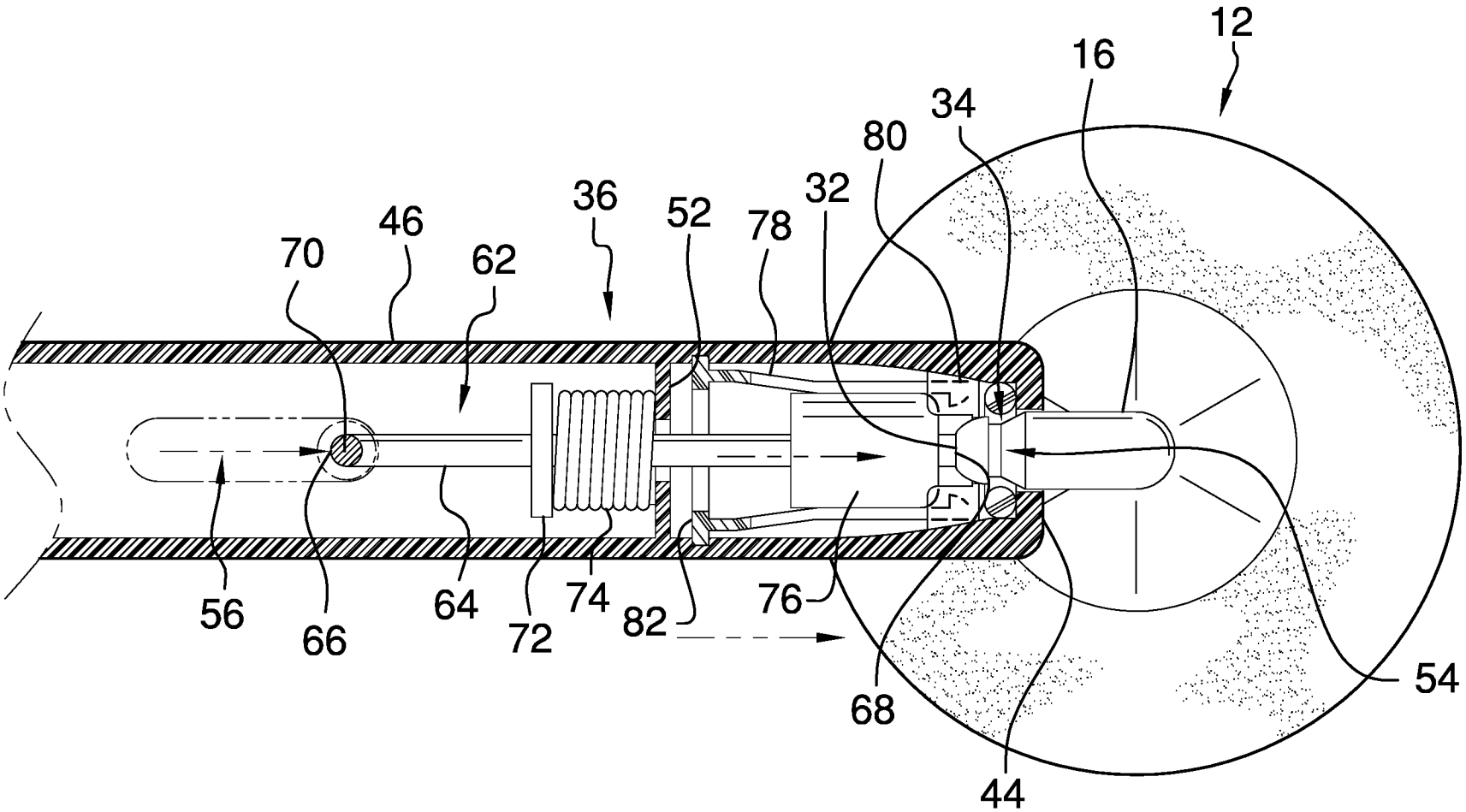
FIG. 6 is a top cut-away view of an embodiment of the disclosure.
Figure 7:
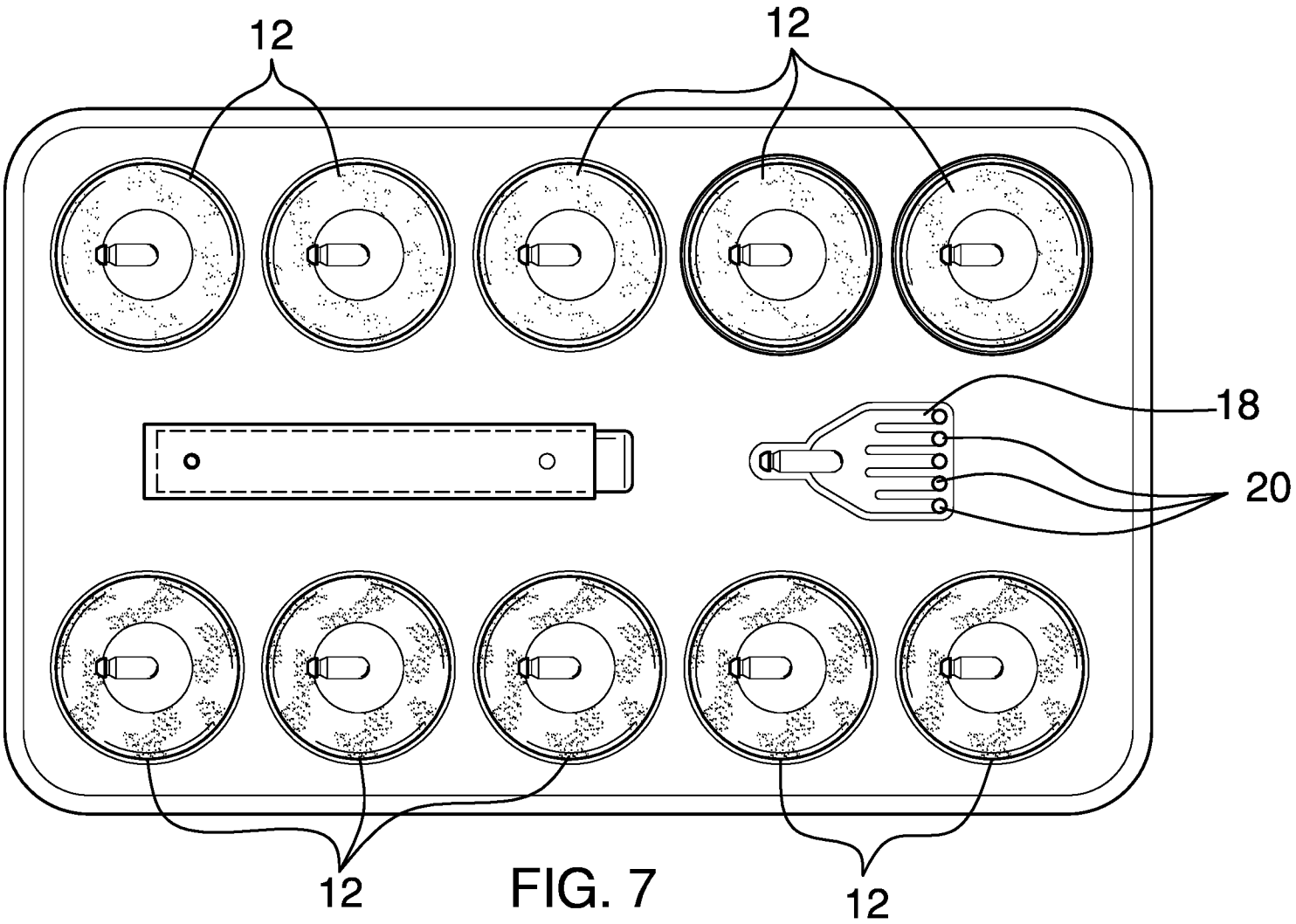
FIG. 7 is a top view of a case, a plurality of applicators, a wand and a back scratcher of an embodiment of the disclosure.
Figure 8:
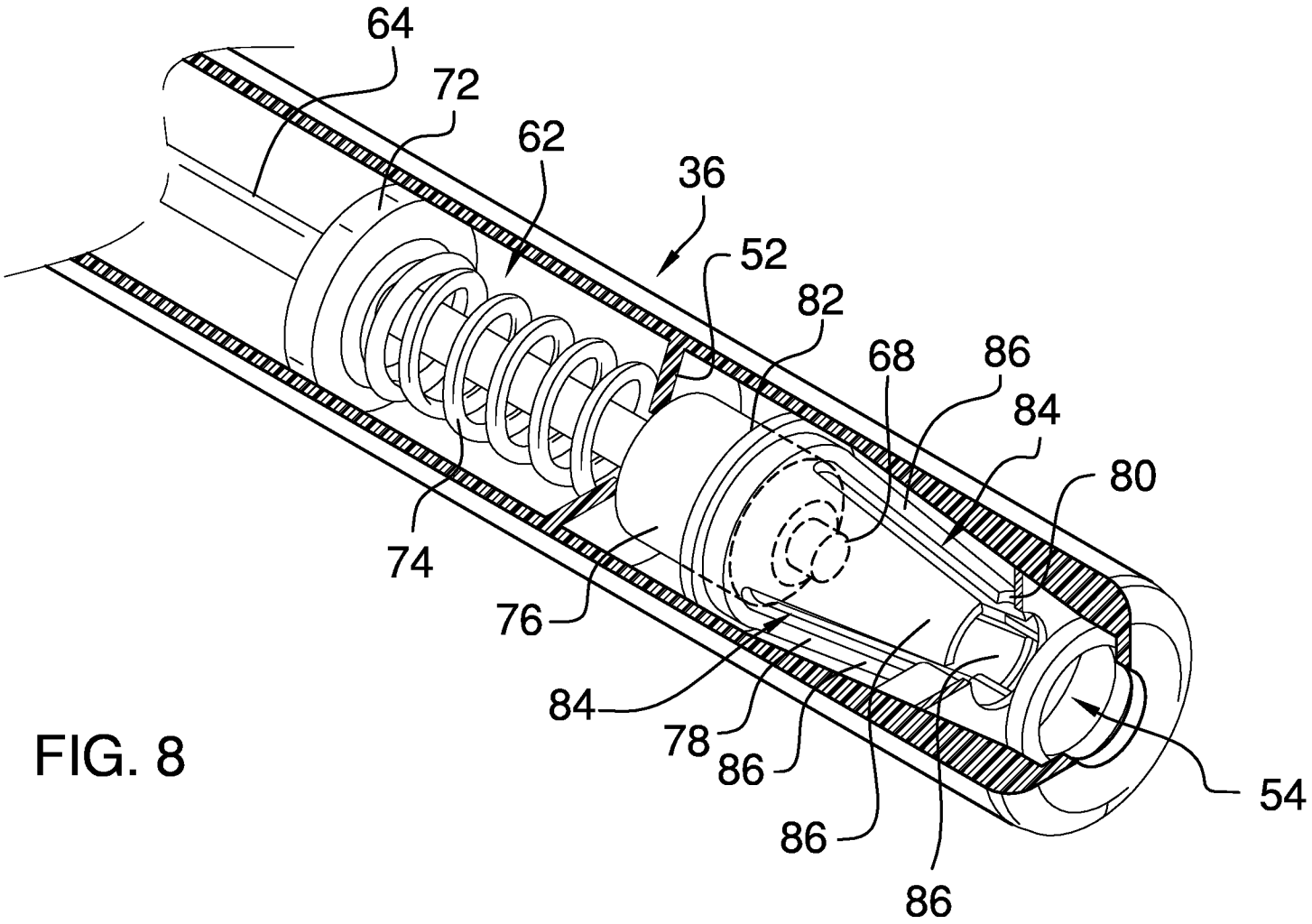
FIG. 8 is a front perspective cut-away view of an embodiment of the disclosure.

With reference now to the drawings, and in particular to FIGS. 1 through 8 thereof, a new applicator device embodying the principles and concepts of an embodiment of the disclosure and generally designated by the reference numeral 10 will be described.

As best illustrated in FIGS. 1 through 8, the lotion applicator assembly 10 generally comprises a plurality of applicators 12 that is each pre-filled with a viscous skin treatment 14. Each of the applicators 12 is substantially comprised of a fluid permeable material to release the viscous skin treatment 14 onto a user's skin. The viscous skin treatment 14 may be lotion, soap or any other liquid that is commonly applied to human skin. Additionally, each of the applicators 12 has a coupler 16 thereon. As is most clearly shown in FIG. 7, a case may be provided for carrying all of the applicators. Additionally, a back scratcher 18 may be provided which includes a plurality of fingers 20 for scratching the user's back that also has a coupler 16 thereon.

Each of the applicators 12 has a top surface 22, a bottom surface 24 and an outer surface 26 extending therebetween; the outer surface 26 is continuously arcuate about a line extending through the top surface 22 and the bottom surface 24 such that each of the applicators 12 has a disk shape. Each of the outer surface 26 and the bottom surface 24 is comprised of a fluid permeable material and the top surface 22 is comprised of a fluid impermeable material. Moreover, the top surface 22 is comprised of a rigid material and the coupler 16 is coupled to the top surface 22. The coupler 16 has a first portion 28 forming an angle with a second portion 30 having the first portion 28 extending upwardly from the top surface 22 and having the second portion 30 being spaced from the top surface 22. The second portion 30 has a distal end 32 and the second portion 30 has a channel 34 extending inwardly therein that is spaced from the distal end 32.

A wand 36 is included that comprises a first half 38 which slidably engages a second half 40 such that the wand 36 has a telescopically adjustable length. The wand 36 has a first end 42, a second end 44 and an outer wall 46 extending therebetween; the first end 42 is associated with the first half 38 and the second end 44 is associated with the second half 40. The outer wall 46 corresponding to the first half 38 has a first hole 48 extending into an interior of the first half 38 and the first hole 48 is positioned adjacent to the first end 42. The outer wall 46 corresponding to the first half 38 has a second hole 50 extending into an interior of the first half 38 and the second hole 50 is positioned adjacent to a termination of the first half 38.

The wand 36 is hollow to define an interior of the wand 36 and the wand 36 has a divider 52 positioned therewithin to define a first portion 28 and a second portion 30 of the interior of the wand 36. The divider 52 is positioned closer to the second end 44 than the first end 42. Additionally, the first portion 28 is associated with the first end 42 of the wand 36 and the second portion 30 is associated with the second end 44 of the wand 36. The second end 44 has an opening 54 extending into an interior of the wand 36 and the outer wall 46 corresponding to the second half 40 has a slot 56 extending into the first portion 28 of the interior of the wand 36.

A lock 58 is movably integrated into the wand 36 and the lock 58 is positioned on the outer wall 46 corresponding to the second half 40. The lock 58 engages the first hole 48 when the wand 36 is positioned in a shortened position and the lock 58 engages the second hole 50 when the wand 36 is positioned in a lengthened position. The lock 58 comprises a ball 60 that is biased outwardly from the outer wall 46 and the ball 60 is positioned adjacent to a termination of the second half 40.

A releasing unit 62 is provided and the releasing unit 62 is movably coupled to the wand 36. The releasing unit 62 engages the coupler 16 on a respective one of the applicators 12 for retaining the respective applicator 12 on the wand 36. In this way the respective applicator 12 can be rubbed on the user's skin. The releasing unit 62 comprises a plunger 64 that has a primary end 66 and a secondary end 68, and the plunger 64 is slidably positioned within the wand 36. The plunger 64 extends through the divider 52 in the wand 36 such that the primary end 66 is positioned in the first half 38 of the interior of the wand 36. Additionally, the secondary end 68 is positioned in the second half 40 of the interior of the wand 36.

The plunger 64 has a button 70 extending upwardly therefrom and the button 70 is positioned in the slot 56 in the outer wall 46 of the second half 40. In this way the button 70 can be manipulated by the user for sliding the plunger 64 back and forth. A washer 72 is coupled around the plunger 64 and the washer 72 is positioned on the first half 38. A biasing member 74 is positioned between the washer 72 and the divider 52, and the biasing member 74 biases the secondary end 68 of the plunger 64 to retract into the opening 54 in the interior of the wand 36.

A stopper 76 is positioned around the plunger 64 and the stopper 76 is positioned between the secondary end 68 of the plunger 64 and the divider 52. The stopper 76 abuts the divider 52 when the biasing member 74 biases the plunger 64 rearwardly in the wand 36 to retain the secondary end 68 of the plunger 64 in the second portion 30 of the interior of the wand 36. A cone 78 is included that has a forward end 80, a back end 82 and an outer wall 84 extending therebetween. Each of the forward end 80 and the back end 82 is open and the outer wall 46 has a plurality of slots 84 each extending from the forward end 80 toward the back end 82. The slots 84 in the cone 78 are spaced apart from each other to define a plurality of sections 86 of the cone 78.

The cone 78 is comprised of a resiliently bendable material and each of the sections 86 of the cone 78 is biased toward each other. In this way each of the sections 86 of the cone 78 engages the channel 34 in the coupler 16 of the respective applicator 12 for removably attaching the respective applicator 12 to the wand 36. The back end 82 of the cone 78 is directed toward the stopper 76. The stopper 76 passes into the cone 78 and urges the plurality of sections 86 away from each other when the plunger 64 is urged forwardly. In this way the sections 86 of the cone 78 can disengage from the channel 34 in the coupler 16 for removing the respective applicator 12 from the wand 36.

In use, the coupler 16 on a respective one of the applicators 12 is inserted into the wand 36 to releasably attach the respective applicator 12 to the wand 36. The wand 36 is positionable in either the shortened position or the lengthened position, depending on the preference of the user. The wand 36 is gripped to facilitate the user to rub the respective applicator 12 on the user's back, and other hard to reach areas on their body, to apply the viscous skin treatment 14. In this way the user can moisturize or clean their back without assistance. The button 70 is slid forwardly to release the respective applicator 12 from the wand 36 when the viscous skin treatment 14 in the respective applicator 12 is depleted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lotion applicator assembly for facilitating a user to apply lotion to the user's back without assistance, said assembly comprising:

a plurality of applicators, each of said applicators being pre-filled with a viscous skin treatment, each of said applicators being substantially comprised of a fluid permeable material wherein each of said applicators is configured to release the viscous skin treatment onto a user's skin, each of said applicators having a coupler thereon;

a wand comprising a first half slidably engaging a second half such that said wand has a telescopically adjustable length; and a releasing unit being movably coupled to said wand, said releasing unit engaging said coupler on a respective one of said applicators for retaining said respective applicator on said wand wherein said respective applicator is configured to be rubbed on the user's skin, said releasing unit being urgeable into a releasing position for disengaging said coupler on said respective applicator;

wherein each of said applicators has a top surface, a bottom surface and an outer surface extending therebetween, said outer surface being continuously arcuate about a line extending through said top surface and said bottom surface such that each of said applicators has a disk shape, each of said outer surface and said bottom surface being comprised of a fluid permeable material, said top surface being comprised of a fluid impermeable material, said top surface being comprised of a rigid material; and wherein said coupler is coupled to said top surface, said coupler having a first portion forming an angle with a second portion having said first portion extending upwardly from said top surface and having said second portion being spaced from said top surface, said second portion having a distal end, said second portion having a channel extending inwardly therein, said channel being spaced from said distal end.

2. The assembly according to claim 1, wherein said wand has a first end, a second end and an outer wall extending therebetween, said first end being associated with said first half, said second end being associated with said second half, said outer wall corresponding to said first half having a first hole extending into an interior of said first half, said first hole being positioned adjacent to said first end, said outer wall corresponding to said first half having a second hole extending into an interior of said first half, said second hole being positioned adjacent to a termination of said first half, said wand being hollow to define an interior of said wand.

3. A lotion applicator assembly for facilitating a user to apply lotion to the user's back without assistance, said assembly comprising:

a plurality of applicators, each of said applicators being pre-filled with a viscous skin treatment, each of said applicators being substantially comprised of a fluid permeable material wherein each of said applicators is configured to release the viscous skin treatment onto a user's skin, each of said applicators having a coupler thereon;

a wand comprising a first half slidably engaging a second half such that said wand has a telescopically adjustable length;

a releasing unit being movably coupled to said wand, said releasing unit engaging said coupler on a respective one of said applicators for retaining said respective applicator on said wand wherein said respective applicator is configured to be rubbed on the user's skin, said releasing unit being urgeable into a releasing position for disengaging said coupler on said respective applicator;

wherein said wand has a first end, a second end and an outer wall extending therebetween, said first end being associated with said first half, said second end being associated with said second half, said outer wall corresponding to said first half having a first hole extending into an interior of said first half, said first hole being positioned adjacent to said first end, said outer wall corresponding to said first half having a second hole extending into an interior of said first half, said second hole being positioned adjacent to a termination of said first half, said wand being hollow to define an interior of said wand; and wherein said wand has a divider being positioned therewithin to define a first portion and a second portion of said interior of said wand, said divider being positioned closer to said second end than said first end, said first portion being associated with said first end of said wand, said second portion being associated with said second end of said wand.

4. A lotion applicator assembly for facilitating a user to apply lotion to the user's back without assistance, said assembly comprising:

a plurality of applicators, each of said applicators being pre-filled with a viscous skin treatment, each of said applicators being substantially comprised of a fluid permeable material wherein each of said applicators is configured to release the viscous skin treatment onto a user's skin, each of said applicators having a coupler thereon;

a wand comprising a first half slidably engaging a second half such that said wand has a telescopically adjustable length;

a releasing unit being movably coupled to said wand, said releasing unit engaging said coupler on a respective one of said applicators for retaining said respective applicator on said wand wherein said respective applicator is configured to be rubbed on the user's skin, said releasing unit being urgeable into a releasing position for disengaging said coupler on said respective applicator;

wherein said wand has a first end, a second end and an outer wall extending therebetween, said first end being associated with said first half, said second end being associated with said second half, said outer wall corresponding to said first half having a first hole extending into an interior of said first half, said first hole being positioned adjacent to said first end, said outer wall corresponding to said first half having a second hole extending into an interior of said first half, said second hole being positioned adjacent to a termination of said first half, said wand being hollow to define an interior of said wand; and wherein said second end has an opening extending into an interior of said wand, said outer wall corresponding to said second half having a slot extending into said first portion of said interior of said wand.

5. A lotion applicator assembly for facilitating a user to apply lotion to the user's back without assistance, said assembly comprising:

a plurality of applicators, each of said applicators being pre-filled with a viscous skin treatment, each of said applicators being substantially comprised of a fluid permeable material wherein each of said applicators is configured to release the viscous skin treatment onto a user's skin, each of said applicators having a coupler thereon;

a wand comprising a first half slidably engaging a second half such that said wand has a telescopically adjustable length;

a releasing unit being movably coupled to said wand, said releasing unit engaging said coupler on a respective one of said applicators for retaining said respective applicator on said wand wherein said respective applicator is configured to be rubbed on the user's skin, said releasing unit being urgeable into a releasing position for disengaging said coupler on said respective applicator;

wherein said wand has a first end, a second end and an outer wall extending therebetween, said first end being associated with said first half, said second end being associated with said second half, said outer wall corresponding to said first half having a first hole extending into an interior of said first half, said first hole being positioned adjacent to said first end, said outer wall corresponding to said first half having a second hole extending into an interior of said first half, said second hole being positioned adjacent to a termination of said first half, said wand being hollow to define an interior of said wand; and wherein said outer wall corresponding to said second half has a slot extending into said first portion of said interior of said wand.

6. A lotion applicator assembly for facilitating a user to apply lotion to the user's back without assistance, said assembly comprising:

a plurality of applicators, each of said applicators being pre-filled with a viscous skin treatment, each of said applicators being substantially comprised of a fluid permeable material wherein each of said applicators is configured to release the viscous skin treatment onto a user's skin, each of said applicators having a coupler thereon;

a wand comprising a first half slidably engaging a second half such that said wand has a telescopically adjustable length;

a releasing unit being movably coupled to said wand, said releasing unit engaging said coupler on a respective one of said applicators for retaining said respective applicator on said wand wherein said respective applicator is configured to be rubbed on the user's skin, said releasing unit being urgeable into a releasing position for disengaging said coupler on said respective applicator;

wherein said wand has a first end, a second end and an outer wall extending therebetween, said first end being associated with said first half, said second end being associated with said second half, said outer wall corresponding to said first half having a first hole extending into an interior of said first half, said first hole being positioned adjacent to said first end, said outer wall corresponding to said first half having a second hole extending into an interior of said first half, said second hole being positioned adjacent to a termination of said first half, said wand being hollow to define an interior of said wand; and a lock being movably integrated into said wand, said lock being positioned on said outer wall corresponding to said second half, said lock engaging said first hole when said wand is positioned in a shortened position, said lock engaging said second hole when said wand is positioned in a lengthened position, said lock comprising a ball being biased outwardly from said outer wall, said ball being positioned adjacent to a termination of said second half.

7. The assembly according to claim 3, wherein said releasing unit comprises a plunger having a primary end and a secondary end, said plunger being slidably positioned within said wand, said plunger extending through said divider in said wand such that said primary end is positioned in said first half of said interior of said wand, said secondary end being positioned in said second half of said interior of said wand, said plunger having a button extending upwardly therefrom.

8. The assembly according to claim 7, further comprising:

a washer being coupled around said plunger, said washer being positioned in said first half; and a biasing member being positioned between said washer and said divider, said biasing member biasing said secondary end of said plunger to retract into said opening in said interior of said wand.

9. The assembly according to claim 7, further comprising a stopper being positioned around said plunger, said stopper being positioned between said secondary end of said plunger and said dividing wall, said stopper abutting said dividing wall when said biasing member biases said plunger rearwardly in said wand to retain said secondary end of said plunger in said second portion of said interior of said wand.

10. The assembly according to claim 9, further comprising a cone having a forward end, a back end and an outer wall extending therebetween, each of said back end and said forward end being open, said outer wall having a plurality of slots each extending from said forward end toward said back end, said slots being spaced apart from each other to define a plurality of sections of said cone.

11. The assembly according to claim 10, wherein said cone is comprised of a resiliently bendable material, each of said sections of said cone being biased toward each other such that each of said sections of said cone engages said channel in said coupler of said respective applicator for removably attaching said respective applicator to said wand, said back end being directed toward said stopper.

12. The assembly according to claim 11, wherein said stopper passes into said cone and urging said plurality of sections away from each other when said plunger is urged forwardly thereby facilitating said sections of said cone to disengage from a channel in said coupler for removing said respective applicator from said wand.

13. A lotion applicator assembly for facilitating a user to apply lotion to the user's back without assistance, said assembly comprising:

a plurality of applicators, each of said applicators being pre-filled with a viscous skin treatment, each of said applicators being substantially comprised of a fluid permeable material wherein each of said applicators is configured to release the viscous skin treatment onto a user's skin, each of said applicators having a coupler thereon, each of said applicators having a top surface, a bottom surface and an outer surface extending therebetween, said outer surface being continuously arcuate about a line extending through said top surface and said bottom surface such that each of said applicators has a disk shape, each of said outer surface and said bottom surface being comprised of a fluid permeable material, said top surface being comprised of a fluid impermeable material, said top surface being comprised of a rigid material, said coupler being coupled to said top surface, said coupler having a first portion forming an angle with a second portion having said first portion extending upwardly from said top surface and having said second portion being spaced from said top surface, said second portion having a distal end, said second portion having a channel extending inwardly therein, said channel being spaced from said distal end;

a wand comprising a first half slidably engaging a second half such that said wand has a telescopically adjustable length, said wand having a first end, a second end and an outer wall extending therebetween, said first end being associated with said first half, said second end being associated with said second half, said outer wall corresponding to said first half having a first hole extending into an interior of said first half, said first hole being positioned adjacent to said first end, said outer wall corresponding to said first half having a second hole extending into an interior of said first half, said second hole being positioned adjacent to a termination of said first half, said wand being hollow to define an interior of said wand, said wand having a divider being positioned therewithin to define a first portion and a second portion of said interior of said wand, said divider being positioned closer to said second end than said first end, said first portion being associated with said first end of said wand, said second portion being associated with said second end of said wand, said second end having an opening extending into an interior of said wand, said outer wall corresponding to said second half having a slot extending into said first portion of said interior of said wand;

a lock being movably integrated into said wand, said lock being positioned on said outer wall corresponding to said second half, said lock engaging said first hole when said wand is positioned in a shortened position, said lock engaging said second hole when said wand is positioned in a lengthened position, said lock comprising a ball being biased outwardly from said outer wall, said ball being positioned adjacent to a termination of said second half; and a releasing unit being movably coupled to said wand, said releasing unit engaging said coupler on a respective one of said applicators for retaining said respective applicator on said wand wherein said respective applicator is configured to be rubbed on the user's skin, said releasing unit comprising:

a plunger having a primary end and a secondary end, said plunger being slidably positioned within said wand, said plunger extending through said divider in said wand such that said primary end is positioned in said first half of said interior of said wand, said secondary end being positioned in said second half of said interior of said wand, said plunger having a button extending upwardly therefrom, said button being positioned in said slot in said outer wall of said second half wherein said button is configured to be manipulated by the user for sliding said plunger back and forth;

a washer being coupled around said plunger, said washer being positioned in said first half;

a biasing member being positioned between said washer and said divider, said biasing member biasing said secondary end of said plunger to retract into said opening in said interior of said wand;

a stopper being positioned around said plunger, said stopper being positioned between said secondary end of said plunger and said dividing wall, said stopper abutting said dividing wall when said biasing member biases said plunger rearwardly in said wand to retain said secondary end of said plunger in said second portion of said interior of said wand; and a cone having a forward end, a back end and an outer wall extending therebetween, each of said forward end and said back end being open, said outer wall having a plurality of slots each extending from said forward end toward said back end, said slots being spaced apart from each other to define a plurality of sections of said cone, said cone being comprised of a resiliently bendable material, each of said sections of said cone being biased toward each other such that each of said sections of said cone engages said channel in said coupler of said respective applicator for removably attaching said respective applicator to said wand, said back end being directed toward said stopper, said stopper passing into said cone and urging said plurality of sections away from each other when said plunger is urged forwardly thereby facilitating said sections of said cone to disengage from said channel in said coupler for removing said respective applicator from said wand.

* * * * *